US006523282B1

(12) United States Patent
Johnston

(10) Patent No.: US 6,523,282 B1
(45) Date of Patent: Feb. 25, 2003

(54) ARTICLE OF FOOTWEAR FOR GRIPPING AND KICKING A BALL

(75) Inventor: Craig Johnston, Lane End Bucks (GB)

(73) Assignee: Reebok International Ltd., Canton, MA (US)

( * ) Notice: Subject to any disclaimer, the term of this patent is extended or adjusted under 35 U.S.C. 154(b) by 0 days.

(21) Appl. No.: 09/684,811

(22) Filed: Oct. 10, 2000

(51) Int. Cl.[7] ..... A43B 5/00
(52) U.S. Cl. ..... 36/133
(58) Field of Search ..... 36/133, 128, 77 R

(56) References Cited

U.S. PATENT DOCUMENTS

| | | | |
|---|---|---|---|
| 3,191,321 A | | 6/1965 | Brütting |
| 4,442,615 A | | 4/1984 | Danks |
| 5,216,827 A | * | 6/1993 | Cohen |
| 5,437,112 A | | 8/1995 | Johnston |

FOREIGN PATENT DOCUMENTS

| | | | |
|---|---|---|---|
| DE | 2255628 | * | 11/1972 |
| DE | 27 43 666 | | 3/1978 |
| DE | 2801984 | * | 7/1979 |
| DE | 2827172 | * | 1/1980 |
| EP | 496931 | * | 8/1992 |
| GB | 6995 | | of 1901 |
| GB | 202859 | | 5/1923 |
| GB | 2 259 639 A | | 3/1993 |
| RU | 2015675 | * | 7/1994 |
| WO | WO 92/22224 | | 12/1992 |

* cited by examiner

*Primary Examiner*—Ted Kavanaugh
(74) *Attorney, Agent, or Firm*—Sterne, Kessler, Goldstein & Fox, P.L.L.C.

(57) ABSTRACT

An article of footwear for use in playing soccer or other activities that require kicking and/or handling of a ball by a player's feet. The article of footwear has a ball control region comprised of a series of raised geometric protrusions which give the player grip and purchase on the ball. The ball control region is formed of three interrelated layers. Each layer is formed of a separate material with a distinct function. The outer layer is comprised of a material which deforms easily and acts to attract and slow the ball during handling by the player. The inner middle layer is comprised of a material that deforms but is harder and more resilient than the outer layer to enhance or over-emphasize a particular effect a player is trying to achieve with the ball. The core layer is comprised of a high tensile metal or plastic to provide a player with extra power and energy during power kicks. Further, the three layers of the ball control region act in unison to allow the player to achieve a variety of desired effects on the ball.

1 Claim, 6 Drawing Sheets

ARTICLE OF FOOTWEAR FOR GRIPPING AND KICKING A BALL

BACKGROUND OF THE INVENTION

1. Field of the Invention

The present invention relates generally to athletic footwear. More particularly, this invention relates to athletic footwear used in soccer or other sports which require kicking and/or dribbling of a ball with the wearer's feet.

2. Related Art

Soccer shoes are used by a wearer to dribble, kick and pass a ball. In each function, it is beneficial for the wearer to be able to handle and control the ball easily and effectively with the soccer shoe. It is also beneficial to have a soccer shoe that enables the wearer to impart spin and increase power to the ball as it is kicked. Further, a soccer shoe that improves a wearer's ability to control and kick the ball as environmental conditions become adverse, such as when it is cold, wet and/or muddy, is crucial to a wearer's consistent performance.

In light of the above, numerous attempts have been made over the years to incorporate into a soccer shoe some type of ball handling surface attached to the shoe upper that provides a wearer with better grip and purchase of a ball. In U.S. Pat. No. 3,191,321 to Brutting, rubber projections were inserted through holes in the toe portion and medial and lateral vamp portions of the soccer shoe upper to form a ball control surface. This arrangement attempted to address problems of prior shoes of this type i.e., unsatisfactory shape of projections, construction and method of securing the projections to the upper. Whereas the rubber projections of the shoe of U.S. Pat. No. 3,191,321 are such as to perhaps improve ball contact and control, they may have the adverse effect of dampening a wearer's power kick due to the compressibility of the material contacting the ball.

The design of the soccer shoe in U.S. Pat. No. 5,437,112 to Johnston includes rubber formations applied over flat and/or concave ball contact areas. The effectiveness of the ball contact areas of U.S. Pat. No. 5,437,112 is premised on the "squaring-off" of the toe box so that the shoe has increased surface area on the inner medial and lateral shoe vamp. The rubber formations on the ball control surface are comprised of either thinner, flexible rubber to provide flexibility and feel to the wearer for improved dribbling and ball control or of rubber of sufficient thickness to remain stable for power kicking. In order to get both effects in one shoe, it is necessary for a wearer to secure a harder, thicker kicking attachment to a "dribbling" shoe. Thus, the design of the shoe does not readily accommodate a soccer player's need for a soccer shoe that will aid the wearer in dribbling and controlling the ball as well as power kicking and passing the ball.

Accordingly, what is needed is a soccer shoe which incorporates a ball control system that includes a means to provide adequate dribbling and controlling features to the wearer and means of applying or increasing power or influence over the ball during kicking and passing. In addition, the ball control system must be integrated into the soccer shoe in such a manner as to not impede a player's speed by being too heavy or cumbersome.

SUMMARY OF THE INVENTION

To achieve the foregoing and other objects, and in accordance with the purposes of the present invention as embodied and broadly described herein, the article of footwear of the present invention comprises a ball control and influence system. The system of the present invention includes a ball control region that is comprised of three interrelated materials serving three different functions that is disposed on an outer surface of a soccer shoe upper.

The soccer shoe of the present invention enables the wearer to control the ball while dribbling and to achieve rapid control of the ball upon receipt of a pass. The soccer shoe also provides means of applying or increasing power and influence over the ball while power kicking and passing. Due to the relative movement between the ball control region and the outer surface of the upper upon contact with a ball and the composition of the ball control region, the soccer shoe allows the wearer to impart spin or other forms of induced movement of the ball so as to selectively vary the flight of the ball.

The soccer shoe of the present invention includes a ball control region attached to an outer surface of the upper. The ball control region is comprised of a series of raised geometric protrusions constructed of three layers of interrelated materials. The material of each layer is chosen to perform a specific function so that in unison the three layers allow a wearer to impart a variety of desired effects on the ball.

The outer layer is comprised of a soft and pliable rubber that deforms easily and provides grip when in contact with a ball. The gripping nature of the outer layer acts like tentacles to both attract and slow down the ball when receiving it and then keeping it steady when preparing to shoot. The outer layer is tactile so that the wearer is able to feel the ball to effectively dribble and carry it down the field under any environmental condition.

The inner middle layer is comprised of a harder, more resilient rubber compound than that of the outer layer. The inner middle layer in conjunction with the outer layer deforms around the outer surface of a ball to enhance or over-emphasize the particular effect that the wearer wants to achieve with the ball. Thus, a wearer can more effectively make short passes and/or maneuver about other players by applying greater force between the ball control region and the ball surface and deforming the inner middle layer of material.

The core layer is comprised of a very thin layer of high tensile metal or plastic. This area provides a wearer with the means of applying and/or increasing power and influence to the ball. A wearer is able to achieve an extra belt of power and effect when the three layers of the ball control region are deformed in unison during hard contact with the ball.

In another embodiment of the present invention, a soccer shoe is made with a ball control surface that is comprised of a series of raised geometric protrusions of various sizes that are arranged on the soccer shoe upper in a manner that allows the wearer to impart a variety of desired effects on the ball, such as more spin and/or power to the ball. The ball control region is divided into a throat region which surrounds the laces of the soccer shoe upper and medial and lateral regions. The geometric protrusions of each region are formed from a single rubber compound. However, the type of rubber compound used for the geometric protrusions of the throat, medial and lateral regions may vary. Thus, the rubber material selected for the geometric protrusions of the throat region of the upper may have a different density/hardness than the rubber material selected for the geometric protrusions which cover the lateral and medial regions of the ball control surface.

Further features and advantages of the present invention, as well as the structure and operation of various embodiments of the present invention, are described in detail below with reference to the accompanying drawings.

BRIEF DESCRIPTION OF THE FIGURES

The accompanying drawings, which are incorporated herein and form part of the specification, illustrate the present invention and together with the description further serve to explain the principles of the invention and to enable a person skilled in the pertinent art to make and use the invention.

DETAILED DESCRIPTION OF THE PREFERRED EMBODIMENTS

A preferred embodiment of the present invention is now described with reference to the figures where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant art that this invention can also be employed in a variety of other applications.

Figure 1:
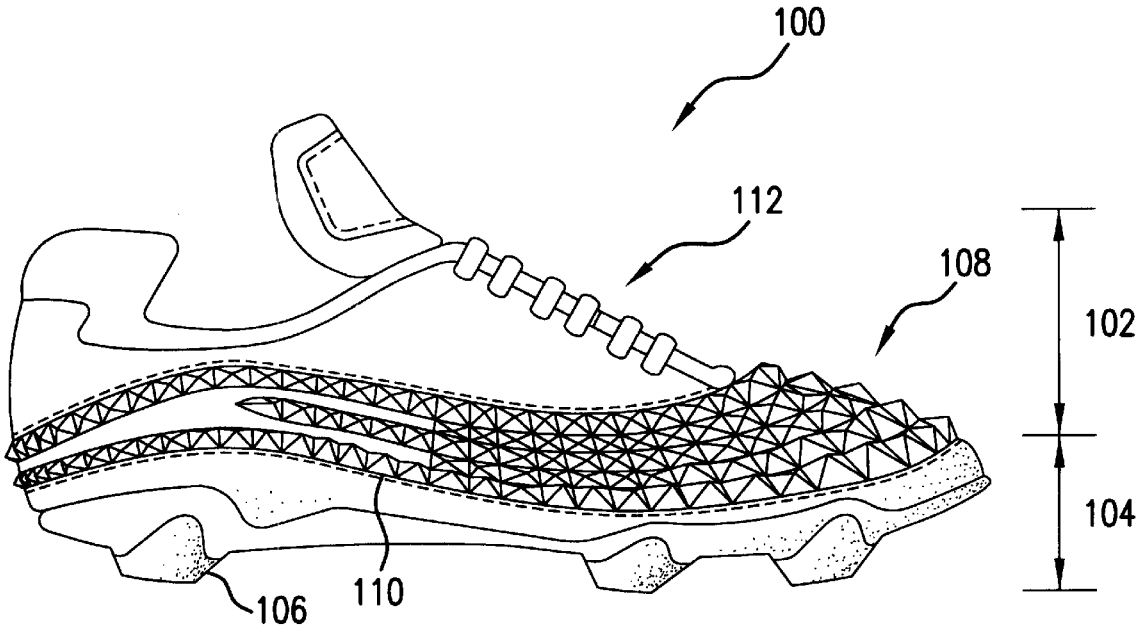
FIG. 1 is a lateral side view of one embodiment of an article of footwear in accordance with the present invention.
Figure 2:
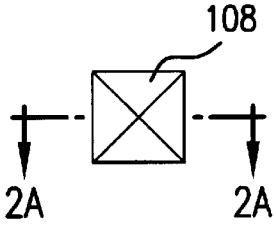
FIG. 2 is a top plan view of a geometric protrusion of FIG. 1.
Figure 3A:
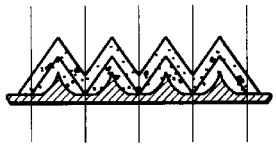
FIG. 3A is a cross-sectional view taken along line 3A—3A of FIG. 3.
Figure 2A:
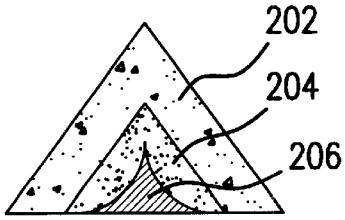
FIG. 2A is a cross-sectional view taken along line 2A—2A of FIG. 2.
Figure 3:
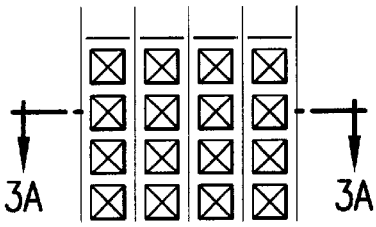
FIG. 3 is a top plan view of a series of geometric protrusions of FIG. 1.
Figure 4:
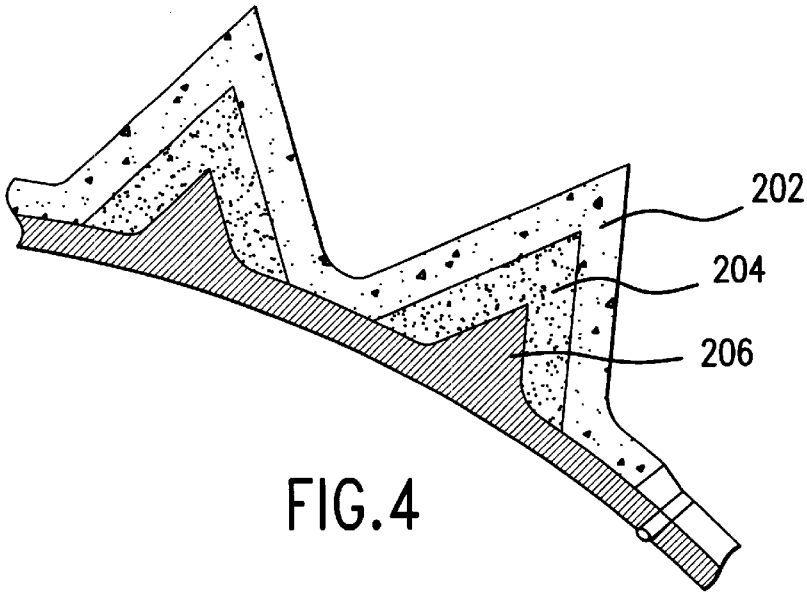
FIG. 4 is a cross-sectional view of a series of geometric protrusions of FIG. 1 in a relaxed state.

A lateral side view of soccer shoe 100 in accordance with the present invention is shown in FIG. 1. Soccer shoe 100 has upper 102 and sole 104 provided with studs 106. Upper 102 may be made of leather. In another embodiment of the present invention, upper 102 may be made of any suitable synthetic material, including a combination of fabric and plastic. Sole 104 and studs 106 are integrally formed of plastic in an injection molding process. In another embodiment, sole 104 and studs 106 may be formed separately and attached one to the other in any means apparent to a person skilled in the relevant art given the present description and application.

Ball control region 108 is attached to upper 102 and is comprised of a series of geometric protrusion 110 formed in rows. In another embodiment of the present invention, ball control region 108 may be formed integrally with upper 102. Each geometric protrusion 110 is generally pyramidal and of substantially equal dimensions. The geometry and size of geometric protrusion 110 provides multidirectional performance for the wearer. Ball control region 108 wraps around the outer surface of upper 102 below fastening portion 112 such that a ball may be controlled about this entire region. In another embodiment of the present invention, geometric protrusions may be of various shapes and dimensions and formed about the ball control region in any suitable arrangement in keeping with the present description and application.

Figure 5:
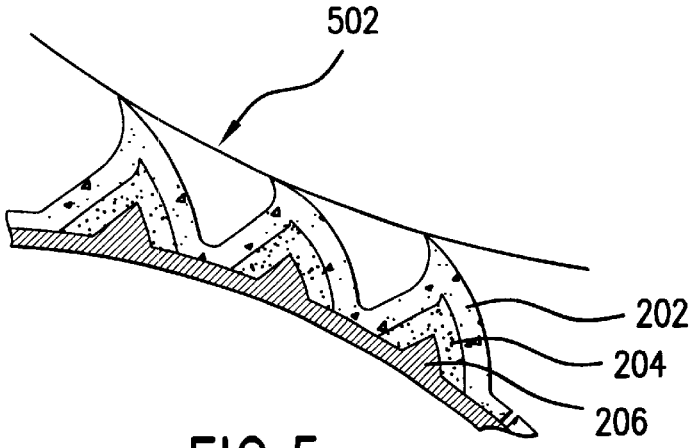
FIG. 5 is a cross-sectional view of a series of geometric protrusions of FIG. 1 wherein an outer layer is deformed under soft contact with a ball.
Figure 6:
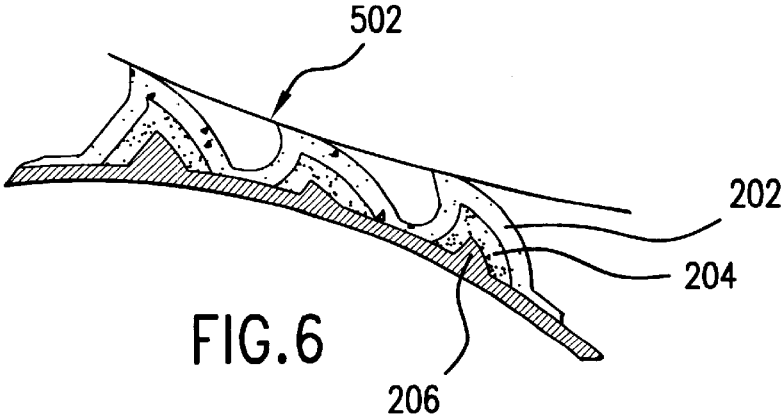
FIG. 6 is a cross-sectional view of a series of geometric protrusions of FIG. 1 wherein an outer layer and an inner middle layer are deformed under hard contact with a ball.
Figure 7:
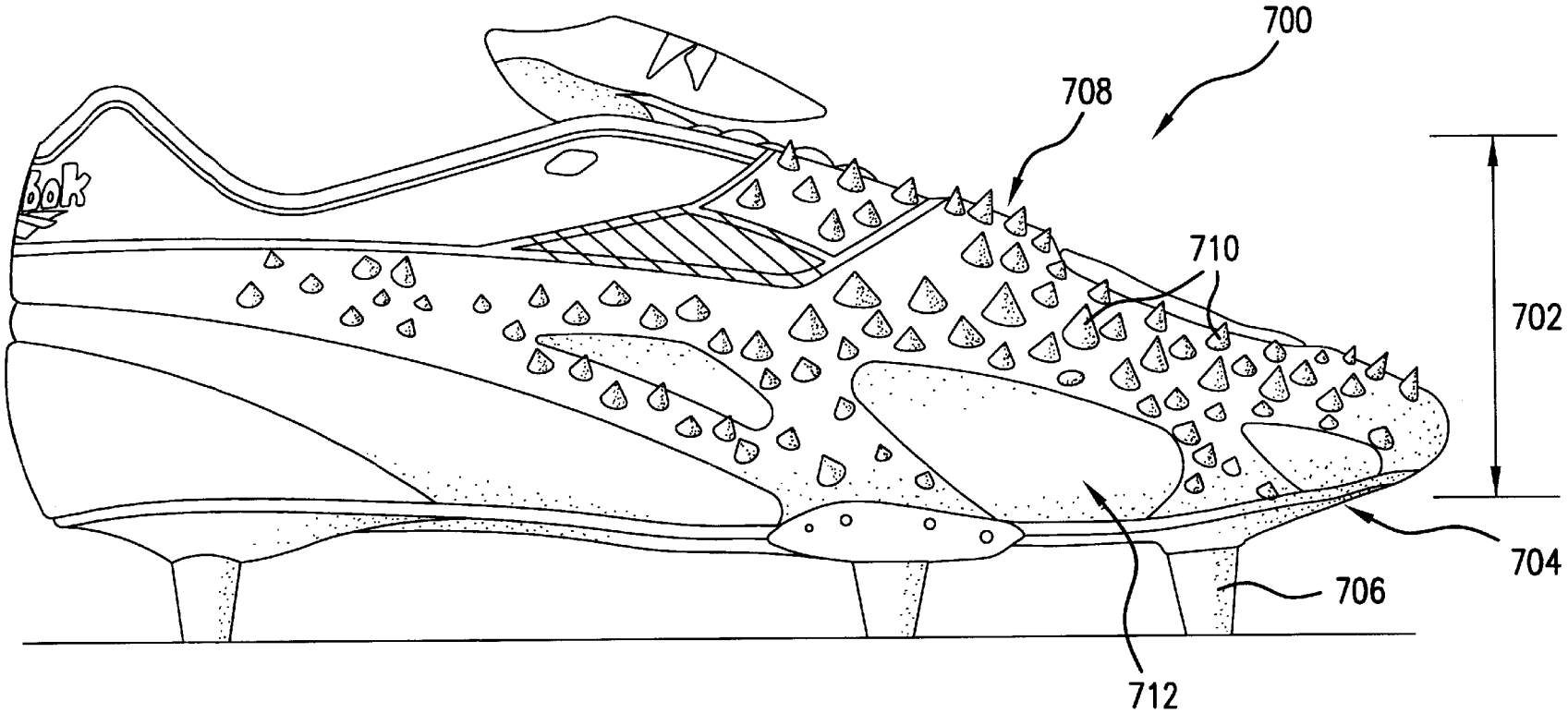
FIG. 7 is a medial side view of a second embodiment of an article of footwear in accordance with the present invention.
Figure 8:
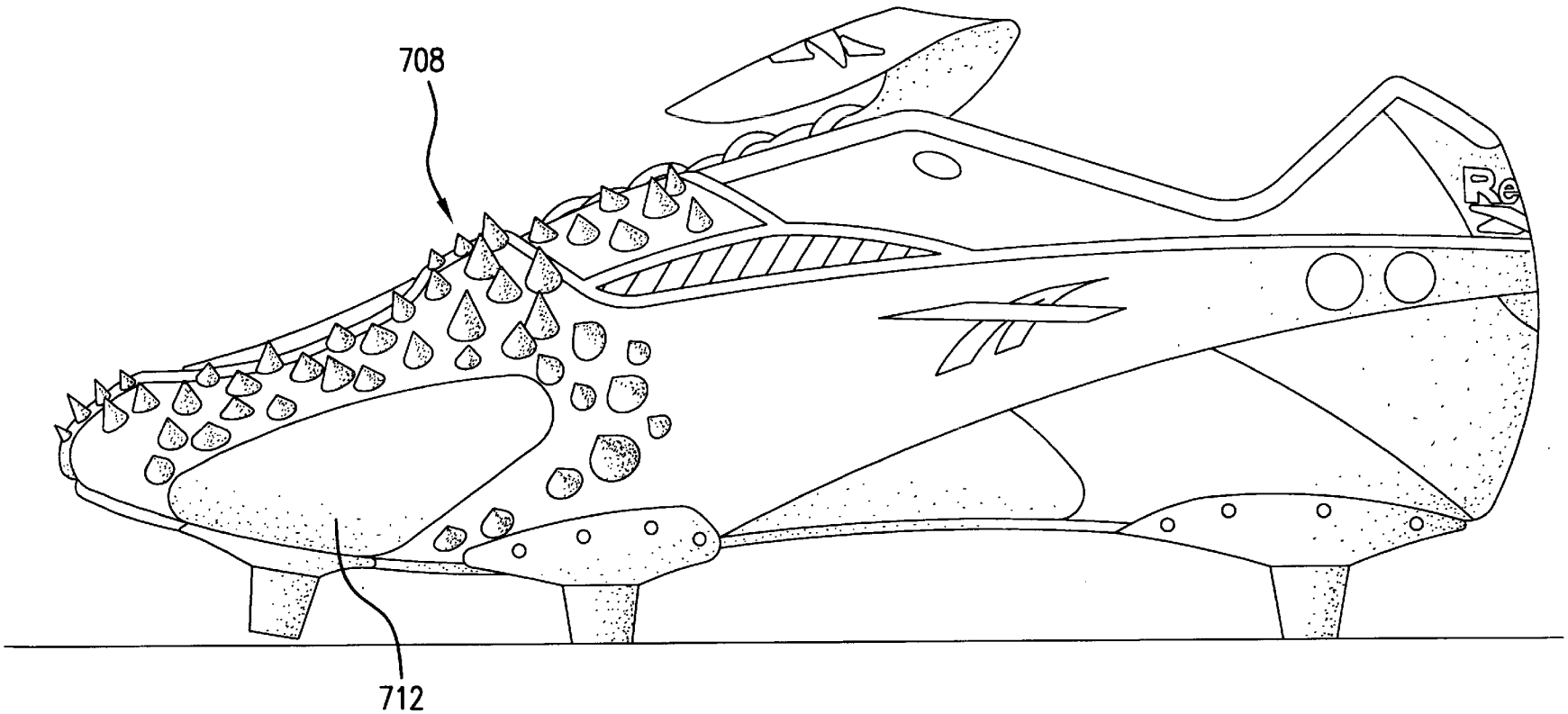
FIG. 8 is a lateral side view of the article of footwear of FIG.7.

As shown in FIGS. 2, 2A, 3 and 4, ball control region 108 may be formed of three distinct and interrelated layers. Outer layer 202 is formed of a soft and pliable rubber that deforms easily and has the property of acting like tentacles to both attract and slow the ball down when receiving it and then keeping it steady when preparing to shoot. (It is very desirable for accuracy of the kick that the ball stays on the foot for as long as possible, the outer layer has properties to make this possible.) One preferred material is a rubber compound having a Shore hardness of between 60A and 64A. Inner middle layer 204 is formed of a much harder and more resilient rubber compound than outer layer 202. One suitable material is a rubber compound having a Shore hardness of between 49A and 53A. As shown in FIGS. 5 and 6, inner middle layer 204 acts in conjunction with outer layer 202 to deform around the surface of ball 502 to enhance or over-emphasize the particular effect that the wearer wants to put on the ball. Core layer 206 is formed of a very thin high tensile metal or plastic. Core layer 206 creates the real energy and resiliency of ball control region 108 that during a kick gives a belt of extra power and effect while imparting spin on the ball.

Although the above-described embodiment suggests the use of three separate materials for geometric protrusions 110, it may be possible to use a single material with a density that varies from a less dense outer region to a denser inner region. It is also envisioned that for some applications, two materials may be used to accomplish some of the same goals as the three layer geometric protrusion of ball control region 108. Similarly, the ball control region can be tailored for particular functionality by utilizing a fourth material or more.

FIGS. 7 through 10 show an alternate embodiment of the present invention. Soccer shoe 700 has upper 702 and sole 704 provided with studs 706. Ball control surface 708 is attached to an outer surface of upper 702 and is comprised of geometric protrusions 710 that are generally conical. Conical protrusions 710 vary in height from approximately 3 mm to 7 mm and in base diameter from approximately 3 mm to 6 mm.

Ball control surface 708 is arranged such that it defines ball pockets 712 on the outer surface of upper 702. Shorter conical protrusions 710 are arranged directly adjacent ball pockets 712 with taller conical protrusions 710 positioned in step fashion about ball control surface 708 such that a curved surface of the ball is accommodated within ball pockets 712. In a further embodiment of the present invention, the shorter conical protrusions about the ball pockets are made from a rubber compound that is harder than the rubber compound used to form the taller conical protrusions on the remainder of the ball control surface.

Figure 9:
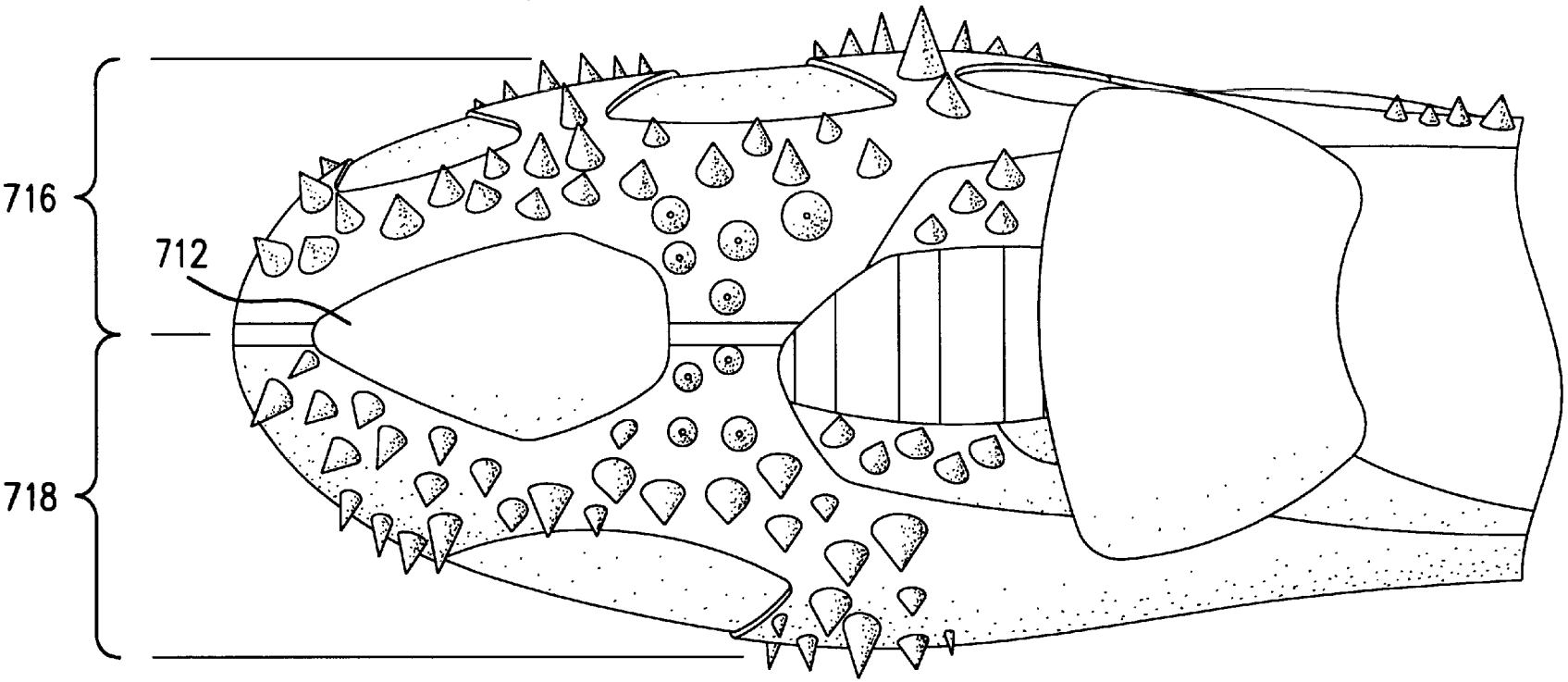
FIG. 9 is a top view of the article of footwear of FIG. 7.
Figure 10:
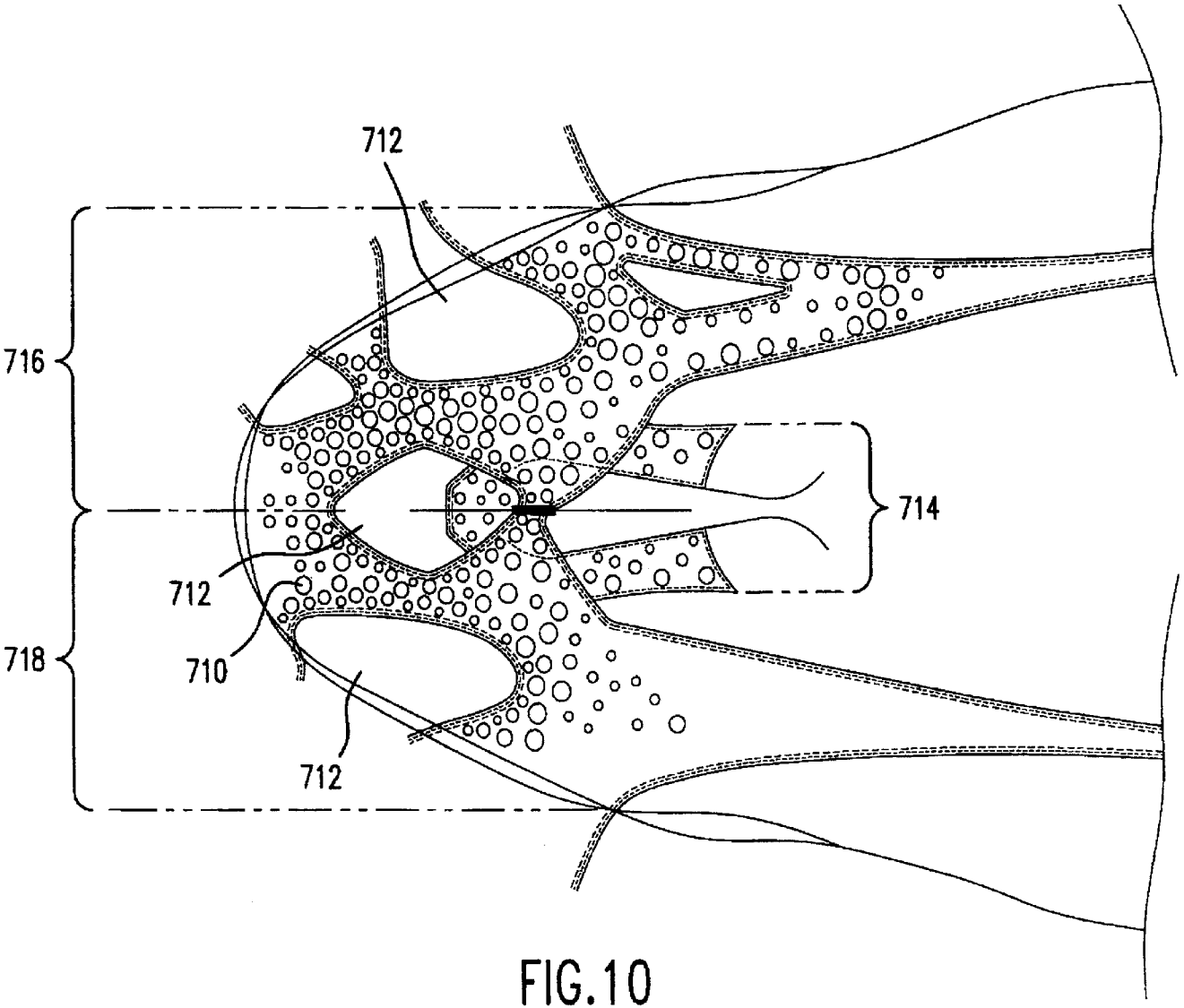
FIG. 10 is a top plan view of the ball control region of FIG. 7.

Conical protrusions 710 of ball control surface 708 are each formed of a single rubber compound. However, the properties of the rubber compound used to produce the conical protrusions varies according to which region of ball control surface 708 the conical protrusions are to be placed on soccer shoe upper 702. As shown in FIGS. 9 and 10, ball control surface 708 is comprised of a throat region 714, a medial region 716 and a lateral region 718, wherein the rubber compound used to form the conical protrusions thereon varies from region to region. Particularly, the rubber used for the "U-shaped" throat region 714 of ball control surface 708 is of a harder rubber material, such as PGM 44 with a Shore hardness of 50A, to allow the wearer to increase the power and influence over the ball when the ball is kicked from within this region of the shoe. In contrast, medial and lateral regions 716 and 718 of ball control surface 708 are made of a softer rubber material, such as PGM 50 with a Shore hardness of 62A, which slightly deforms around the surface of a ball to allow the wearer to enhance or over-emphasize the particular effect that the wearer wants to achieve with the ball, by keeping the ball on the wearer's foot longer.

Ball control region 708 may also be removable from the upper to allow ball control regions having different characteristics to be interchanged on a single upper. For example, the ball control region could be attached with snaps, a hook and pile fastener or in any other convenient manner. Individual geometric protrusions might also be replaceable so that an individual soccer player may tailor his/her ball control region to suit his/her individual needs or desires.

While various embodiments of the present invention have been described above, it should be understood that they have been presented by way of example, and not limitation. It will be apparent to persons skilled in the relevant art that various changes in form and detail can be made therein without departing from the spirit and scope of the invention. Thus the present invention should not be limited by any of the above-described exemplary embodiments, but should be defined only in accordance with the following claims and their equivalents. All cited patent documents and publications in the above description are incorporated herein by reference.

What is claimed is:

1. An article of footwear to provide grip and purchase on a ball comprising:

a sole;

an upper disposed on said sole and having an outer surface; and a ball control surface attached to said outer surface of said upper comprised of a throat region, a medial region and a lateral region, wherein one of said throat, medial or lateral regions includes a material of different hardness than another of said regions, wherein said ball control surface further comprises a series of generally conical geometric protrusions arranged to form a plurality of ball pockets, wherein said generally conical geometric protrusions are of varying dimension such that said generally conical geometric protrusions which are adjacent said ball pockets are smaller in area than said generally conical geometric protrusions about a remainder of said ball control surface.

* * * * *